US005477786A

United States Patent [19]

Leeker et al.

[11] Patent Number: 5,477,786

[45] Date of Patent: Dec. 26, 1995

[54] SUBCALIBER ARROW PROJECTILE

[75] Inventors: Jürgen Leeker, Neuse; Klaus Unterstein, Düsseldorf; Wilhelm Becker, Willich, all of Germany

[73] Assignee: Rheinmetall GmbH, Ratingen, Germany

[21] Appl. No.: 301,898

[22] Filed: Sep. 7, 1994

[30] Foreign Application Priority Data

Sep. 8, 1993 [DE] Germany ..... 43 30 418.4

[51] Int. Cl.[6] ..... F42B 10/48; F42B 8/12; F42B 12/06

[52] U.S. Cl. ..... 102/522; 102/501; 102/529

[58] Field of Search ..... 102/501, 517, 102/519, 520–523, 529, 703, 514–516; 244/3.1, 3.3

[56] References Cited

U.S. PATENT DOCUMENTS

| | | | |
|---|---|---|---|
| 3,515,072 | 6/1970 | Barr | 102/517 |
| 4,015,535 | 4/1977 | Bond, Jr. . | |
| 4,195,573 | 4/1980 | Leeker et al. | 102/520 |
| 4,362,107 | 12/1982 | Romer et al. | 102/520 |
| 4,434,718 | 3/1984 | Kopsch et al. | 102/522 |
| 4,488,491 | 12/1984 | Rhodes | 102/522 |
| 4,638,739 | 1/1987 | Sayles | 102/520 |
| 4,850,280 | 7/1989 | Wallow et al. | 102/522 |
| 4,961,384 | 10/1990 | Sayles | 102/519 |
| 5,070,791 | 12/1991 | Dineen et al. | 102/517 |

FOREIGN PATENT DOCUMENTS

| | | |
|---|---|---|
| 0264546 | 4/1988 | European Pat. Off. . |
| 0265369 | 4/1988 | European Pat. Off. . |
| 2747313 | 4/1979 | Germany . |
| 4119785 | 12/1992 | Germany . |
| 4141560 | 6/1993 | Germany . |

*Primary Examiner*—Harold J. Tudor
*Attorney, Agent, or Firm*—Spencer, Frank & Schneider

[57] ABSTRACT

A subcaliber arrow projectile includes a projectile body which has a rearwardly widening, conical projectile tip having a forward point and a rearward base, whose caliber corresponds to the projectile caliber. The projectile body further has a rearwardly widening, resistance-stabilizing conical rear part immediately adjoining the base of the projectile tip. The rear part has an enlarged caliber which is greater than the projectile caliber.

8 Claims, 1 Drawing Sheet

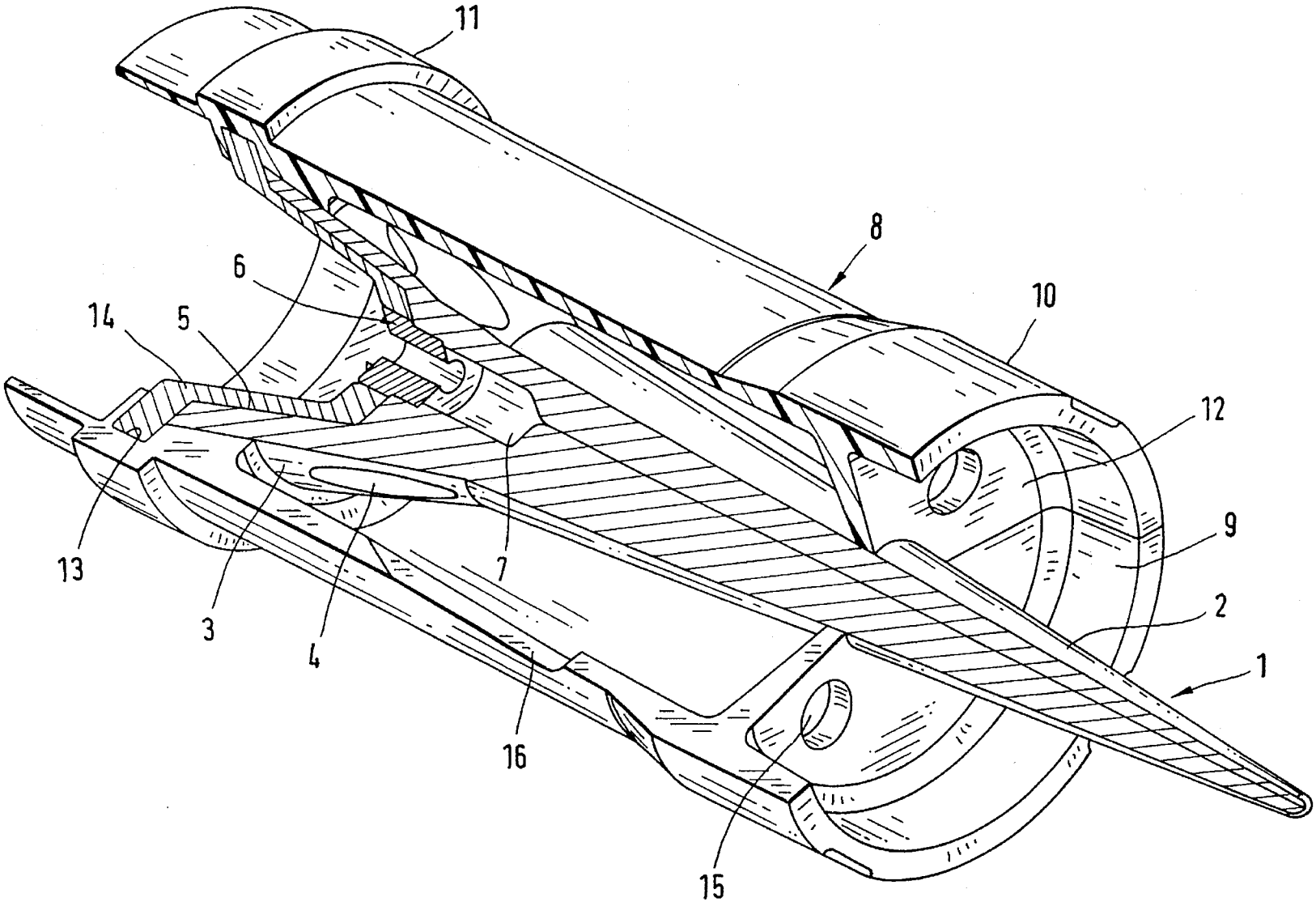
1
2
9
12
10
8
11
6
5
14
13
3
4
7
16
15

SUBCALIBER ARROW PROJECTILE

BACKGROUND OF THE INVENTION

This invention relates to a subcaliber arrow projectile of shortened range, having a projectile body of determined caliber. The projectile body includes a conical tip whose base has the caliber of the projectile body and a resistance-stabilizing conical rear part of increased caliber. In the region of increased caliber the rear part may have bore holes which extend essentially parallel to the axis of the projectile body and may further be provided with a rearward widening frustoconical bay.

Subcaliber arrow projectiles of the above-outlined type are used in general against armored targets and have, upon launching, a very high initial velocity, a high flight velocity and a possibly low air resistance. Because for safety reasons the firing ranges have a limited area, the above-noted characteristics make it difficult to test and practice with such projectiles. Further, in case of a small elevation of the barrel and a very flat trajectory, ricocheted projectiles may reach undesirably large distances and may leave the limited space prescribed for the firing range. The same considerations apply in case a target is missed.

German Patent No. 2,747,313 therefore discloses a subcaliber arrow projectile of the above-outlined type, serving as a practice ammunition, whose projectile body is stretched long and is cylindrical and has a conical tip as well as a frustoconical rear part which is of greater caliber than that of the projectile body. The cone angle of the rear part approximately corresponds to that of the conical tip. The rear part leads, in the lower Mach range, to a rapid deceleration of the projectile, whereby its range is limited while its flight attitude in the range of the normal fighting distance corresponds to that of a normal projectile for battle use. Such a practice ammunition is, however, relatively heavy and needs a correspondingly large propellant charge for firing.

SUMMARY OF THE INVENTION

It is an object of the invention to provide a subcaliber arrow projectile of the above-outlined type for practice purposes which has a small weight and thus requires a small propellant charge for firing.

This object and others to become apparent as the specification progresses, are accomplished by the invention, according to which, briefly stated, the conical tip of the projectile extends to the beginning of the rear part.

BRIEF DESCRIPTION OF THE DRAWING

The sole FIGURE is a perspective, broken-away view of a preferred embodiment of the invention.

DESCRIPTION OF THE PREFERRED EMBODIMENT

Turning to the FIGURE, the arrow projectile of shortened range illustrated therein includes a projectile body 1 which has a stretched, conical tip 2 whose base corresponds to the caliber of the projectile body 1. The projectile body further has a resistance-stabilizing conical rear part 3 which immediately adjoins the conical tip 2 and has an enlarged caliber and thus a greater cone angle than the conical tip 2.

The rear part 3 which is formed as an apertured cone guide assembly has, in the zone of enlarged caliber, holes 4 which extend generally in the direction of the projectile axis, but are slightly offset relative thereto to cause a rotation of the projectile. The rear part 3 is formed as a dual cone, that is, it is provided with a rear frustoconical bay 5. The projectile body 1 may further have a rearward axial recess 7 for accommodating a tracer charge.

The projectile body 1 is preferably a one-piece (steel) cast component.

The illustrated arrow projectile has a two-part discarding sabot 8 which may be made, for example, of an aluminum alloy or, in particular, of a synthetic material. It is shaped as a cylinder that resists bending and buckling to a great degree and which, at its front end, is provided with an air pocket 9. The sabot 8 has a forward and a rearward band region 10 and 11, respectively, for guiding or for guiding and sealing. In the frontal band region 10 each longitudinal half of the sabot 8 is provided with a transverse radial wall 12 which forms the base of the air pocket 9 and which surrounds and holds the projectile body 1 in its frontal region. Further, each half of the sabot 8 is, in the rear zone, provided with a circumferential groove 13 for receiving a propelling disk 14 which is of conical configuration and is provided with a circumferential flange received in the groove 13. The cone angle of the propelling disk 14 corresponds to the cone angle of the bay 5 at the rear end of the projectile body 1 so that the latter (up to the region of the screw 6) is in full engagement with the propelling disk 14.

The sabot 8 and the projectile body 1, together with the propellant disk 14 undergo the same acceleration during firing so that no differential forces appear between the sabot 8 and the projectile body 1. The sabot 8 therefore needs to carry only itself and may be, for this reason, a component made particularly of plastic. The guide or sealing bands 10, 11 may be directly integrated with the plastic sabot 8, that is, they may be manufactured as a one-piece component therewith in an injection molding process.

In the transverse (radial) wall 12 of the sabot 8 axial holes 15 are provided. While the projectile passes through the weapon barrel, the inner space of the sabot 8 is pressurized with the pressure in the weapon barrel. By virtue of the delayed expansion of the thus-preserved gas cushion, upon leaving the barrel a parallel separating motion of the two halves of the sabot 8 is initiated.

Laterally in the region of the parting plane of the two halves of the sabot 8 holes 16 may be provided for the escape of gases and for the purpose of weight reduction. The wall thickness of the sabot 8 expediently gradually increases towards the rear.

It will be understood that the above description of the present invention is susceptible to various modifications, changes and adaptations, and the same are intended to be comprehended within the meaning and range of equivalents of the appended claims.

What is claimed is:

1. Practice ammunition comprising a subcaliber arrow projectile including a projectile body; said projectile body having (a) a conical projectile tip having a forward point and a rearward cone base; said base having a caliber corresponding to the projectile caliber; said conical projectile tip having a forwardly-oriented cone angle; and (b) a conical rear part immediately adjoining said base of said conical projectile tip; said conical rear part having a forwardly-oriented cone angle greater than said cone angle of said conical projectile tip said conical rear part having an enlarged caliber greater than said projectile caliber.

2. Practice ammunition as defined in claim 1, wherein said rear part has, in a zone of said enlarged caliber, a plurality of generally axially extending holes.

3. Practice ammunition as defined in claim 1, wherein said rear part has a rearwardly oriented, rearwardly widening frustoconical bay.

4. Practice ammunition as defined in claim 1, wherein said projectile body is a one-piece cast component.

5. Practice ammunition as defined in claim 1, further comprising (a) a multi-part discarding guiding sabot surrounding said projectile body and having, at a rear sabot portion, an inwardly oriented circumferential groove; and (b) a propelling disk having a peripheral region received by said circumferential groove.

6. Practice ammunition as defined in claim 5, wherein said sabot is of plastic.

7. Practice ammunition comprising a subcaliber arrow projectile including a single-piece, cast projectile body; said projectile body having (a) a conical projectile tip including a forward point and a rearward cone base; said base having a caliber corresponding to the projectile caliber; and (b) a conical rear part immediately adjoining said base of said conical projectile tip; said rear part having (1) an enlarged caliber greater than said projectile caliber;

(2) a plurality of generally axially extending holes in a zone of said enlarged caliber; and (3) a rearwardly oriented, rearwardly widening frustoconical bay.

8. The practice ammunition as defined in claim 7, further comprising (a) a multi-part discarding guiding sabot surrounding said projectile body and having, at a rear sabot portion, an inwardly oriented circumferential groove; and (b) a propelling disk having a peripheral region received by said circumferential groove.

* * * * *